US005251459A

United States Patent [19]

Grass et al.

[11] Patent Number: 5,251,459

[45] Date of Patent: Oct. 12, 1993

[54] THERMAL EXPANSION VALVE WITH INTERNAL BY-PASS AND CHECK VALVE

[75] Inventors: Thomas Grass; Robert W. Haul, both of St. Louis County, Mo.

[73] Assignee: Emerson Electric Co., St. Louis, Mo.

[21] Appl. No.: 861,318

[22] Filed: Mar. 31, 1992

Related U.S. Application Data

[63] Continuation-in-part of Ser. No. 706,374, May 28, 1991, abandoned.

[51] Int. Cl.[5] ..... F25B 13/00

[52] U.S. Cl. ..... 62/324.1; 236/92 B; 137/539

[58] Field of Search ..... 62/160, 324.6; 236/92 B; 137/599, 539

[56] References Cited

U.S. PATENT DOCUMENTS

| | | | |
|---|---|---|---|
| 2,841,174 | 7/1958 | Frye | 137/539 X |
| 3,252,297 | 5/1966 | Leimbach et al. | 62/225 |
| 3,324,673 | 6/1967 | Lindahl et al. | 62/196 |
| 3,343,564 | 9/1967 | Peeples et al. | 137/539 |
| 3,367,362 | 2/1968 | Hoffman | 137/517 |
| 3,699,778 | 10/1972 | Orth | 62/225 |
| 4,214,698 | 7/1980 | Josefsson | 236/42 |
| 4,852,364 | 8/1989 | Seener et al. | 62/225 |
| 4,964,567 | 10/1990 | Heffner | 236/92 B |

*Primary Examiner*—William E. Wayner

*Attorney, Agent, or Firm*—Polster, Lieder, Woodruff & Lucchesi

[57] ABSTRACT

A reversible flow thermal expansion valve for use in a heat system is disclosed wherein the thermal expansion valve includes a valve body having a flowpath therethrough with an inlet and outlet, an expansion port within the flowpath, and an expansion valve to open and close the expansion port. An internal by-pass flow path by-passes the expansion port for reverse flow through the expansion valve. A check valve in the by-pass flow path prevents refrigerant from by-passing the expansion port during regular, forward flow through the expansion valve. The check valve has a spring to bias the check valve normally closed, and a bypass port communicating between a check valve guide path chamber and a check valve outlet in order to relieve pressure in the guide path chamber and increase the flow rate through the check valve.

10 Claims, 4 Drawing Sheets

HEATING CYCLE

COOLING CYCLE.

THERMAL EXPANSION VALVE WITH INTERNAL BY-PASS AND CHECK VALVE

RELATED APPLICATION DATA

This application is a continuation-in-part application of application U.S. Ser. No. 07/706,374 filed May 28, 1991, now abandoned.

BACKGROUND OF THE INVENTION

This invention relates to a thermal expansion valve for use in a heat pump system, and, in particular, to such a thermal expansion valve having an internal check valve.

The operational features of a heat pump system are well known in the art. In general, such systems include a compressor which forces refrigerant to a four way reversing valve. In the cooling cycle, the refrigerant flows from the reversing valve to an outdoor coil (i.e., a condenser), through an expansion valve to an indoor coil (i.e., an evaporator), and back to the compressor by way of the reversing valve. Typically, thermal expansion valves have a relatively small orifice through which the refrigerant entering the cooling coil must flow thus causing an adiabatic expansion of the refrigerant.

Because of the relatively small diameter orfice, thermal expansion valves operate only in one direction. In reverse flow conditions, an attempt to force the refrigerant through the expansion orfice would unduly restrict refrigerant flow. Accordingly, prior art heat pumps were provided with a by-pass around the expansion valves with the by-pass having an external check valve so as to permit flow through the by-pass in only one direction. This separate check valve/by-pass line usually required a field installer to provide two tees in the line on either side of the thermal expansion valve with the check valve installed parallel to the thermal expansion valve. The need for field installation and multiple joints inherent in the use of such external check valves makes the use of such external check valves expensive. It also increases the possibility for leaks and makes infield service checks more difficult and more expensive.

Expansion valves having built-in check valves are known. These overcame the problems of valves with external valves, but they have problems of their own. In one such valve, as shown in U.S. Pat. No. 4,964,567 to Heffner et al, the integral check valve is a flapper check valve. Flapper valves are typically gravity dependent. If mounted in an upright or sideways position, fluid flow is required to keep the valve closed. When mounted upright, gravity acts against the fluid pressure to keep the valve open. Thus, when the heat pump compressor operates the system under low pressure, there may be more pressure pushing the valve open than pushing it closed, and the flapper cannot be maintained closed. This problem is especially acute when fluid pressure is low. Because the check valve cannot be kept closed, it is difficult to control expansion of the liquid through the expansion valve. Further when the valve is used under high pressure, there is a time lag between the start of high pressure flow through the expansion valve and the closing of the flapper valve. During this time period, the valve remains open, and refrigerant can flow into the by-pass tube. Control of the expansion valve is therefore also made difficult. The by-pass tube of this valve is external to the valve. It thus includes auxiliary ports which provide for extra joints which may leak.

Another expansion valve with a built-in check valve is shown in U.S. Pat. No. 4,852,364 to Seener et al. Seener uses a spring biased stem which passes through an adjustable partition member, a slidable cup shaped check valve element, and a guide member to communicate with a follower member of a diaphragm valve. The check valve element is slidable on the guide member. The cup-shaped control valve element has inlet apertures on its sidewalls and a control valve port on its bottom or end wall. Whether the valve element operates as an expansion valve or by-pass depends on the valve element's position on the guide member and its position in relation to a tapered portion of the stem which engages the control valve port. This tapered portion of the stem forms a check valve element. The construction of this valve is both complicated and expensive. Because there are so many parts which slide against each other, the parts must be machined very precisely, thus increasing the cost of production. Further, as the check valve element is dependent upon fluid flow to move it into the by-pass position or into the expansion valve position, the same lag times may be present as are present in the flapper check valve. Thus, this valve may also have problems with control of the superheat during this lag time.

A thermal expansion valve having an internal by-pass is shown in U.S. Pat. No. 3,699,778 to Orth. This expansion valve does not include a check valve. Rather it has complex valve means including an expansion valve member which seats against an expansion port and an internal chamber in this valve member. The internal chamber has equalization ports which are in communication with the valve inlet when the ports are opened The equalization ports are opened and closed by a collar which is connected to the diaphragm by push pins. The outlet of the expansion valve is in communication with a chamber directly beneath the diaphragm. When the compressor is in operation, the push pins push down on the collar to open the expansion port and close the equalization ports. When the compressor shuts down, the evaporator warms up and the forces across the diaphragm tend to balance. The pressure within the valve's internal chamber forces the collar upward opening the equalization ports, thereby allowing reverse flow through the internal chamber. As in the Seener et al expansion valve, there are many parts which will slide against each other requiring precise machining, increasing the cost of production.

Another expansion valve with an internal by-pass is shown in U.S. Pat. No. 3,252,297 to Leimbach et al. This valve includes a flow path having an inlet and an outlet. A slidable tubular member is received in the flowpath. The tubular member is smaller in diameter than the flowpath and thus defines two flowpaths. The inner circular flow path defines the expansion valve flow path and has an expansion port. The outer annular flow path defines the by-pass flow path and has a by-pass port. This is thus a complex valve and requires precise machining. It is complicated and expensive to produce.

SUMMARY OF THE INVENTION

One object of the present invention is to provide a thermal expansion valve having an internal check valve which is positively maintained in a normally closed condition.

Another object is to provide such a valve which is compact, inexpensive to make, and can handle substantially the same fluid flow as prior art valves.

Another object is to provide such a valve wherein there is little or no lag time in the opening and closing of the internal check valve thereby to minimize superheat control problems.

Another object of the valve of this invention is to provide such a valve which may be operated in any desired position.

These and other objects will become apparent to those skilled in the art in light of the following description and accompanying drawings.

Generally stated, this invention relates to a heat pump system including a compressor having an inlet and an outlet. Indoor and outdoor heat exchangers are provided which are in fluid communication with each other. A shiftable four-way valve is connected to the inlet and outlet of the compressor and to the indoor and outdoor heat exchangers. The shiftable four-way valve selectively shifts the flow of refrigerant in the system between its heating and cooling cycles. A thermal expansion valve is installed in the refrigeration system in operating relation with at least one of the heat exchangers. The expansion valve includes a fluid path with an inlet and an outlet and an expansion port therein. A valve member is provided to meter refrigerant through the expansion port and a controller controls the opening and closing (metering) of the valve member. The expansion valve further includes an internal by-pass flowpath having a check valve therein. The check valve is in fluid communication with the valve body flowpath inlet and outlet. The check valve opens upon the reversal of refrigerant flow through the expansion valve to permit the refrigerant to bypass the expansion valve, and closes upon normal refrigerant flow to insure normal operation of the expansion valve. The check valve includes a valve seat, a check valve member which engages the seat to allow the check valve to be closed and a spring which biases the check valve in a normally closed position. The check valve member preferably moves in a guide path between its open and closed positions. In a second embodiment, the guide path is provided with a pressure relief port which places the guide path in fluid communication with the check valve outlet. The pressure relief port provides the fluid in the guide path an escape or by-pass, and is thus not significantly pressurized or compressed when the check valve is opened. Thus, check valve can open more fully, and quickly.

BRIEF DESCRIPTION OF THE DRAWINGS

In the drawings like reference numerals indicate similar parts.

DESCRIPTION OF THE PREFERRED EMBODIMENT

Figure 1:
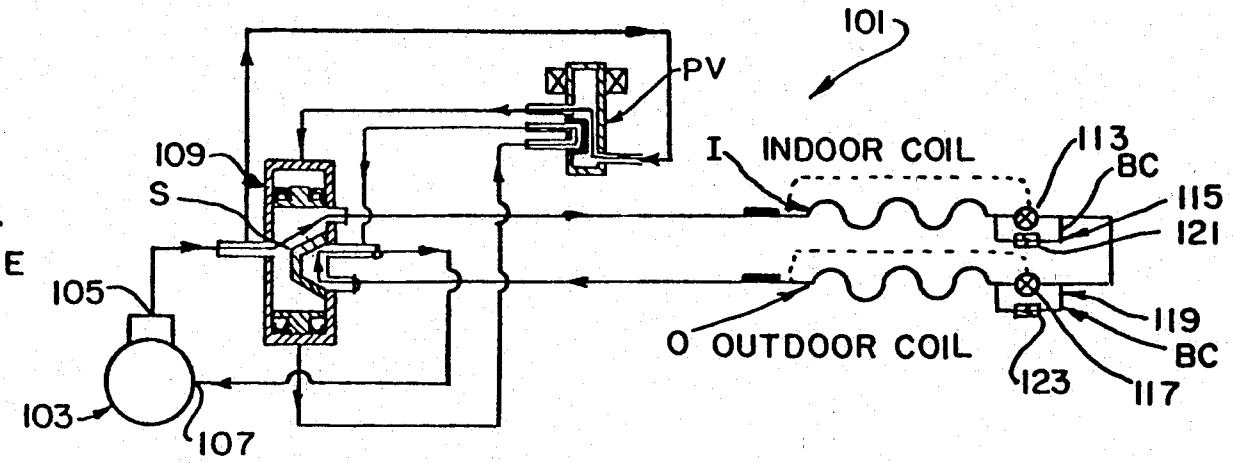
FIG. 1. PRIOR ART.
FIGS. 1 and 2 are diagrammatic views of prior art heat pump systems in heating and cooling cycles, respectively, wherein the heat pump systems required a separate check valve to accompany each thermal expansion valve.
Figure 2:
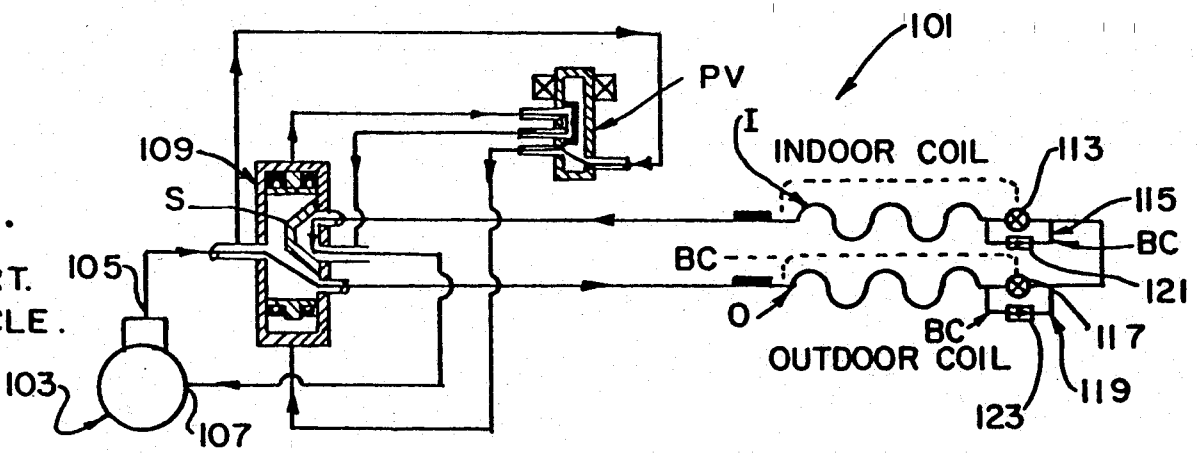
FIG. 2. PRIOR ART.

Referring now to the drawings, and more particularly to FIGS. 1 and 2, a conventional heat pump system is indicated in its entirety by reference character 101. As is conventional, the heat pump system 101 includes a compressor 103 having a refrigerant outlet port 105 and a refrigerant inlet or suction port 107. The high pressure refrigerant discharged from the compressor is directed into a so-called four-way or reversing valve 109 and is directed to a condenser coil in which heat from the high pressure, relatively high temperature, refrigerant is given up to the air. Then, the high pressure, but somewhat cooler, refrigerant is expanded in an expansion valve and is admitted into another coil, referred to as the evaporator. In the evaporator, the low pressure refrigerant, typically in its liquid state, absorbs heat and evaporates thus removing heat from the surroundings. The low pressure refrigerant gas discharged from the evaporator is returned to the suction inlet of the compressor. In the heating cycle for the heat pump system 101, the condenser is located indoors of the building space to be heated such that the heat given off by the refrigerant is discharged into the building space. In the cooling cycle, the flow of refrigerant through the heat pump system is reversed such that the outdoor coil acts as a condenser and the indoor coil acts as an evaporator.

More specifically, the four-way reversing valve 109 includes a shiftable spool S therein such that in the heating mode, the high pressure refrigerant from the compressor is directed to the indoor coil I and such that the refrigerant discharged from the outdoor coil O is directed to the suction inlet 107. A solenoid operated pilot valve PV causes the spool S within the four-way reversing valve to shift such that in the cooling cycle, the refrigerant discharge from the compressor is directed to the outdoor O coil and the gas from the indoor coil I is directed back to the suction inlet 107 of the compressor.

As further indicated in FIGS. 1 and 2, each of the coils I and O has a thermostatic expansion valve 113 and 117 associated with that coil. In addition, a by-pass circuit BC is provided with each expansion valve such that when the refrigerant flow is operated in one direction, all of the refrigerant flow must pass through the respective thermal expansion valve such that the coil downstream from the expansion valve acts as an evaporator and such that as the flow is caused to reverse, substantially all of the flow will readily bypass the expansion valve through the check valve.

Figure 3:
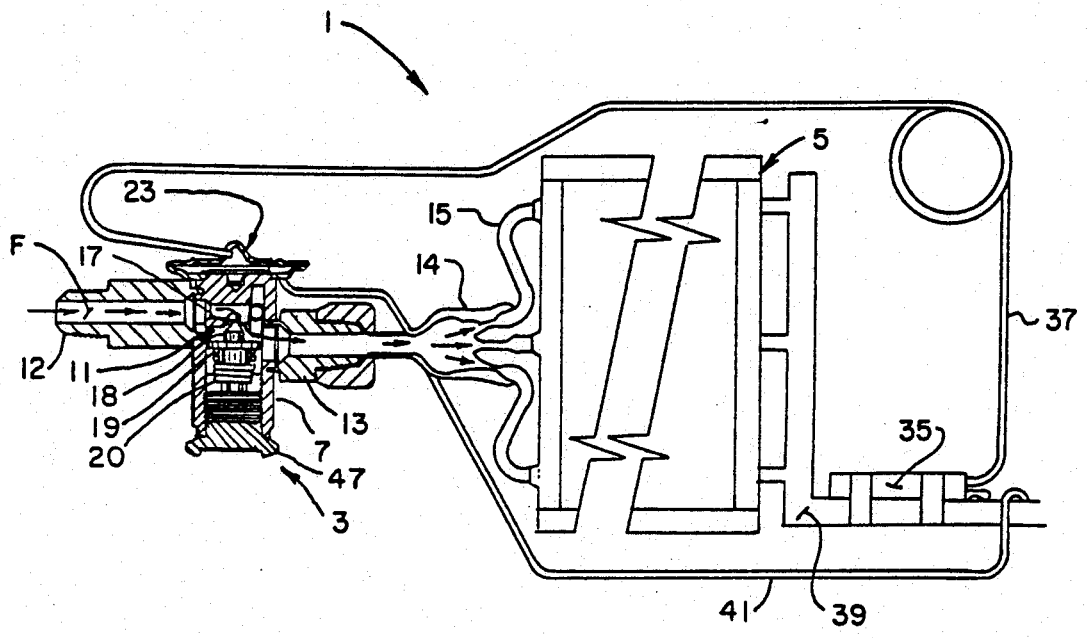
FIGS. 3 and 4 are cross-sectional views of expansion valves of the present invention, shown in forward flow and reverse flow, respectively, in line with a heat exchanger.
Figure 4:
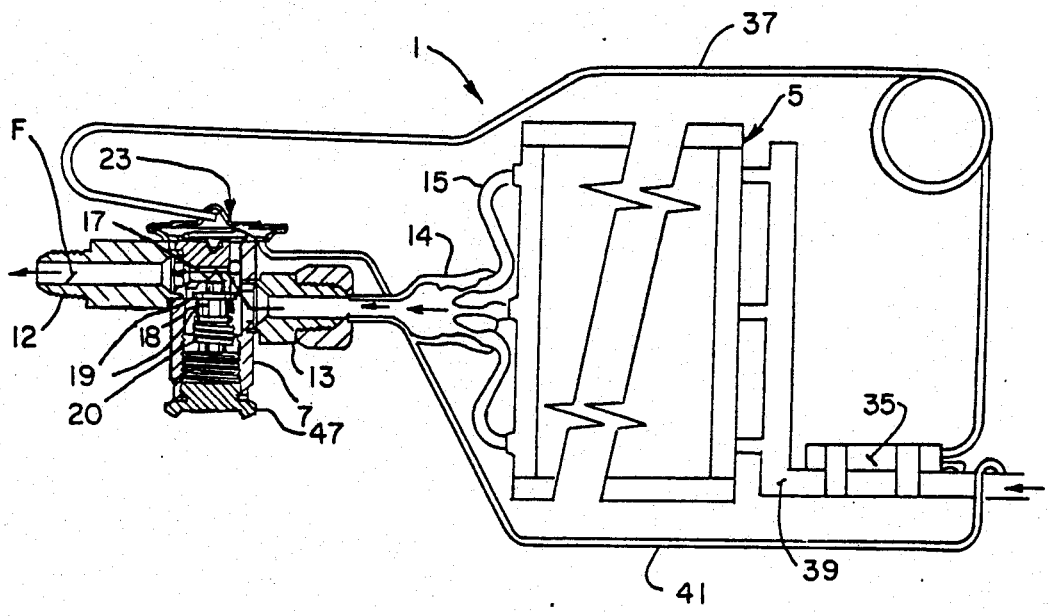

Referring to FIGS. 3 and 4, reference numeral 1 illustrates a portion of heat pump system 101 including a thermal expansion valve 3 and a heat exchanger 5. The heat exchanger 5 will operate either as a condenser or as an evaporator depending on whether the heat pump system is in its cooling or heating mode and could be located indoors or outdoors. Although not shown in FIGS. 3 and 4, heat exchanger 5 and expansion valve 3 are in line with a compressor, a 4-way reversing valve and a solenoid pilot valve to operate the reversing valve, as shown in FIGS. 1 and 2.

In accordance with this invention thermal expansion valve 3 of the present invention incorporates not only an expansion valve, as indicated at 113 or 117 in FIGS. 1 and 2, but also includes an appropriate by-pass circuit analogous to by-pass circuits BC heretofore described.

Figure 7:
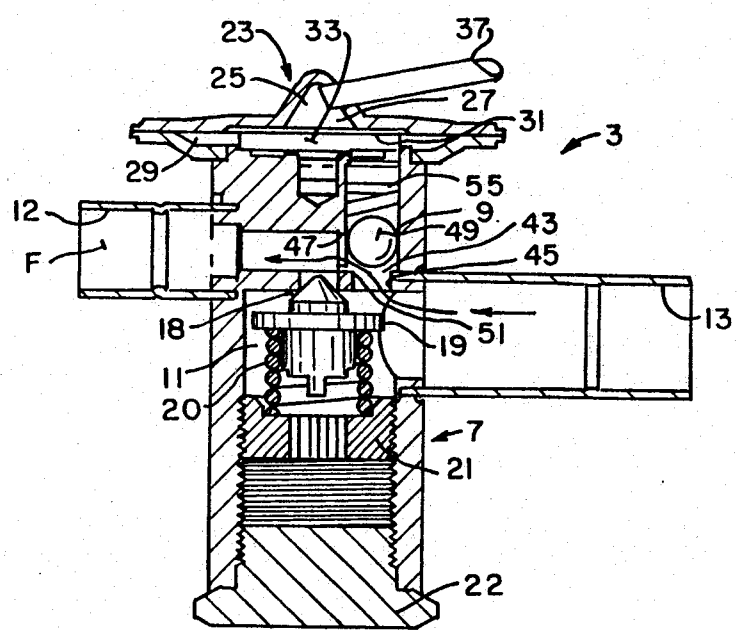
FIGS. 6 and 7 are cross-sectional views of the expansion valve in forward and reverse flow, respectively.
Figure 6:
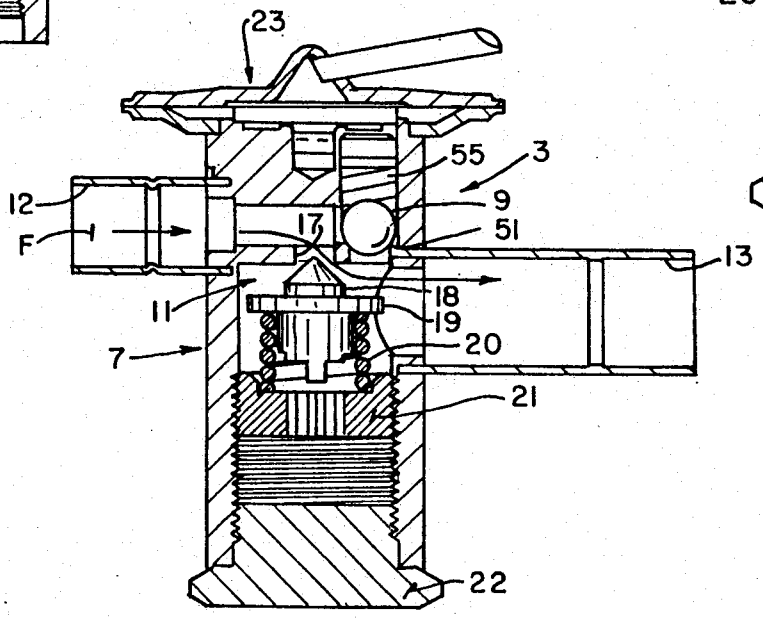
Figure 5:
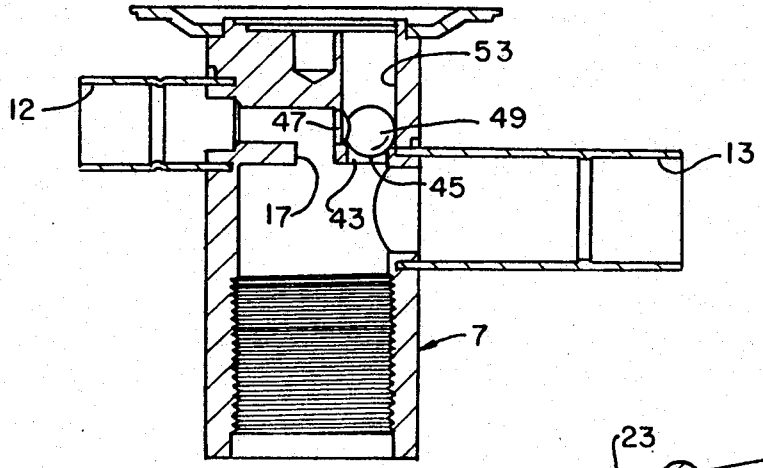
FIG. 5 is a cross-sectional view of a valve body of a thermal expansion valve of the present invention.

As more particularly shown in FIGS. 5-7, the thermal expansion valve 3 of the present invention comprises a body 7 having a check valve assembly 9 and an expansion valve assembly 11 incorporated therein. The valve assemblies 9 and 11 are in fluid communication with each other but are separate from each other. Thus no complex valve parts are needed.

Expansion valve body 7 has a flowpath F therethrough having an inlet 12 and outlet 13 when the flow of refrigerant is in such direction as to cause the refrigerant to adiabatically expand as it flows through the valve. Outlet 13 communicates with heat exchanger 5 through fluid line 14 and feeder tubes 15. Inlet 12 and outlet 13 communicate with the other heat exchanger in the manner shown in FIGS. 1 and 2.

An expansion port 17 is provided within flow path F. A metering valve member 18 having a flange 19 is movable within valve body 7 to selectively open and close expansion port 17. A compression spring 20 biases valve member 18 toward its closed position. Because the valve uses a spring to bias it closed, the valve is not dependant on gravity or fluid pressure to close it. The valve is thus not position sensitive. The superheat setting of the thermal expansion valve 3 may be altered by adjusting a nut 21 positioned beneath spring 20. Valve body 7 is sealed below nut 21 by a cap 22.

A thermostatic head 23 is provided to control the opening and closing of valve 18. As shown in FIGS. 6 and 7, a chamber 25 within thermostatic head 23 is divided into an upper chamber 27 and lower chamber 29 by a diaphragm 31. A load transfer plate 33 is positioned beneath diaphragm 31 and has pushrods (not shown) beneath it which extend down to flange 19 of valve member 18. Upper chamber 27 is in fluid communication with a thermostatic bulb 35 via a capillary tube 37 which is filled with a two phase volatile fluid As shown in FIGS. 3 and 4, bulb 35 is placed in heat transfer relation with an outlet 39 of heat exchanger 5 so as to effectively sense the approximate temperature of the refrigerant discharged from heat exchanger 5. A change in temperature in the outlet 39 will be sensed by bulb 35 and the pressure of the fluid within the capillary tube 37 will change, thereby affecting diaphragm 31. This change of pressure in the diaphragm will thus either relieve or exert pressure on the load transfer plate 33. The pushrods (not shown) transmit this change in pressure to valve 18 to control (modulate) the opening of port 17. An external pressure equalizer tube 41 may be used to connect heat exchanger outlet 39 with lower chamber 29 so that the opening and closing of valve 18 will not be affected by large pressure drops across heat exchanger 5.

As best shown in FIG. 5, flow path F is provided with a by-pass flow path 43 which allows the refrigerant to by-pass expansion port 17. By-pass flow path includes a by-pass inlet 45 in communication with outlet 13 and a by-pass outlet 47 in communication with inlet 12.

Check valve assembly 9 is positioned within by-pass flow path 43. Valve assembly 9 includes a check ball 49 which seats against a check valve seat 51. The check ball 49 is movable within a check ball guide path 53 between a closed position (FIG. 6) and an opened position (FIG. 7). Check ball 49 is biased to be normally closed by a spring 55.

Because check valve 9 is substantially separate from the expansion valve member, the precision machining necessary in the previously noted expansion valves is not necessary. This valve is thus simpler in construction and easier to produce.

In operation, with heat exchanger 5 being located indoors, when the heat pump is in its heating cycle, high temperature, high pressure refrigerant from compressor 103 enters heat exchanger 5 through outlet 39 and then enters valve body 3 through outlet 13, as shown in FIGS. 4 and 7. The fluid entering the heat exchanger 5 acts on check valve ball 49 so as to move it away from seat 51. Thus the system fluid will flow via by-pass flow path 43 from outlet 13 to inlet 12, as best shown by the arrows in FIG. 7. In this manner, refrigerant by-passes expansion port 17. Spring 55, which biases check valve 49 closed, has a spring force sufficiently light so as to permit the check valve 49 to be opened substantially instantaneously when the compressor 103 is operated at low pressure.

When the heat pump system is in cooling mode, the direction of flow is as shown in FIGS. 3 and 6. Fluid enters body 7 through inlet 12 and flows through expansion port 17 to outlet 15. Fluid also flows into by-pass flow path 43 and against check valve 49 which is biased closed by spring 55. The pressure in by-pass flow path 43 aids in holding check valve 49 closed. Because pressure in flowpath F upstream of expansion port 17 is greater than downstream of the port, the pressure holding valve 49 closed is greater than the pressure pushing valve 49 open and coolant will not flow through by-pass flowpath 43. Thus, all the coolant will flow through expansion port 17 to the heat exchanger 5, even at low operating pressures. Further, because spring 55 biases check valve 49 closed, valve 49 will substantially instantly close upon reversing the flow of coolant, and the lag time that was experienced in the prior art valves is greatly reduced.

Figure 8:
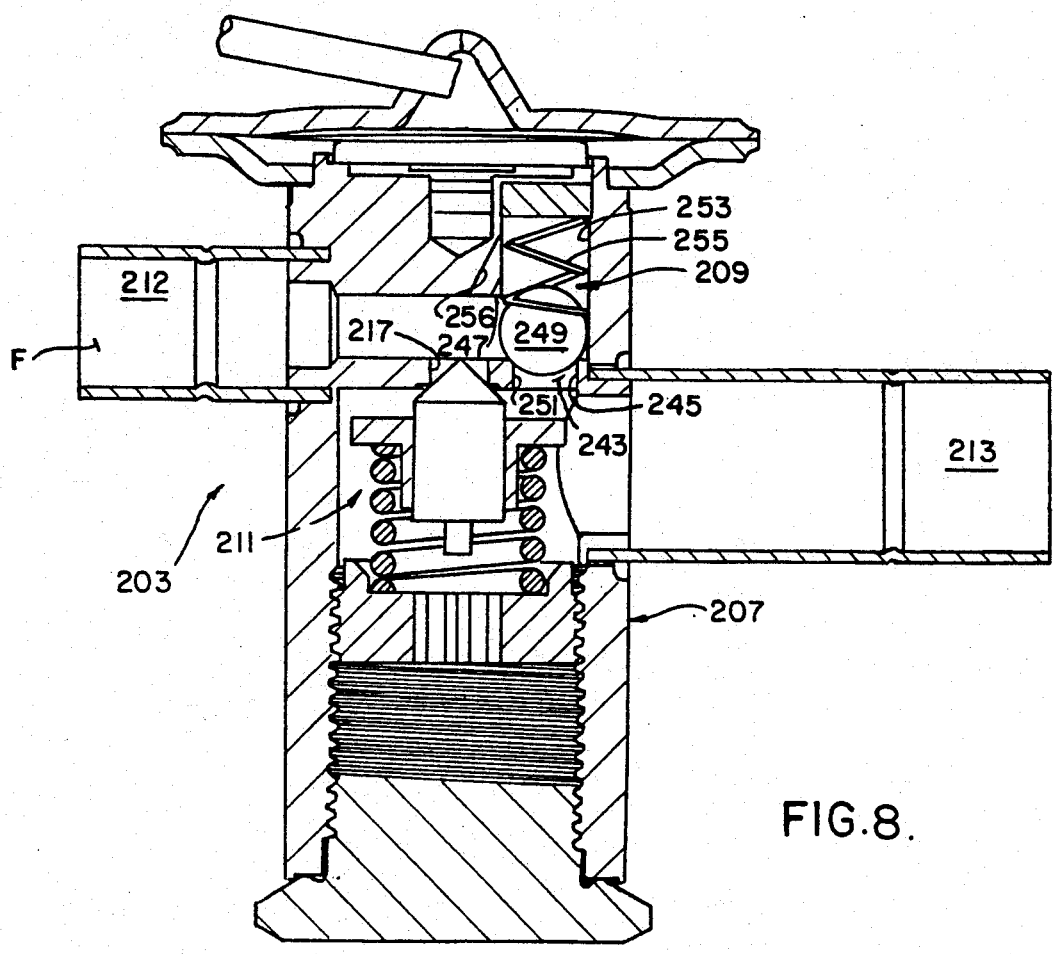
FIG. 8 is a cross-sectional view showing a second embodiment of an expansion valve having a check valve pressure relief port.

Turning to FIG. 8, reference numeral 203 refers to a second embodiment of a thermal expansion valve. Expansion valve 203 includes a body 207 having formed therein a check valve assembly 209 and an expansion valve assembly 211. Valve 203 differs only in respect to the design of the check valve assembly 209. Expansion valve assembly 211 is the same as expansion valve assembly 11 and will not be describe.

Check valve assembly 209 is formed in a by-pass flow path 243 which allows the refrigerant to by-pass expansion port 217 in flow path F. By-pass flow path 243 includes a by-pass inlet 245 in communication with flow path outlet 213 and a by-pass outlet 247 in communication with flow path inlet 212. Check valve assembly 209 is positioned within by-pass flow path 243. Valve assembly 209 includes a check ball 249 which seats against a check valve seat 251. The check ball 249 is movable within a check ball guide path chamber 253 between a closed position and an opened position. Check ball 249 is biased to be normally closed by a spring 255 located behind check ball 249 and within check ball guide path chamber 253.

Check valve assembly 209 differs from check valve assembly 9 in that the check ball guide path chamber 253 is provided with a pressure relief or by-pass port 256. Port 256 places guide path chamber 253 in communication with by-pass flow path outlet 247. Relief port 256 is a bore formed in valve body 207. It thus does not require extra fluid connections.

Figure 9:
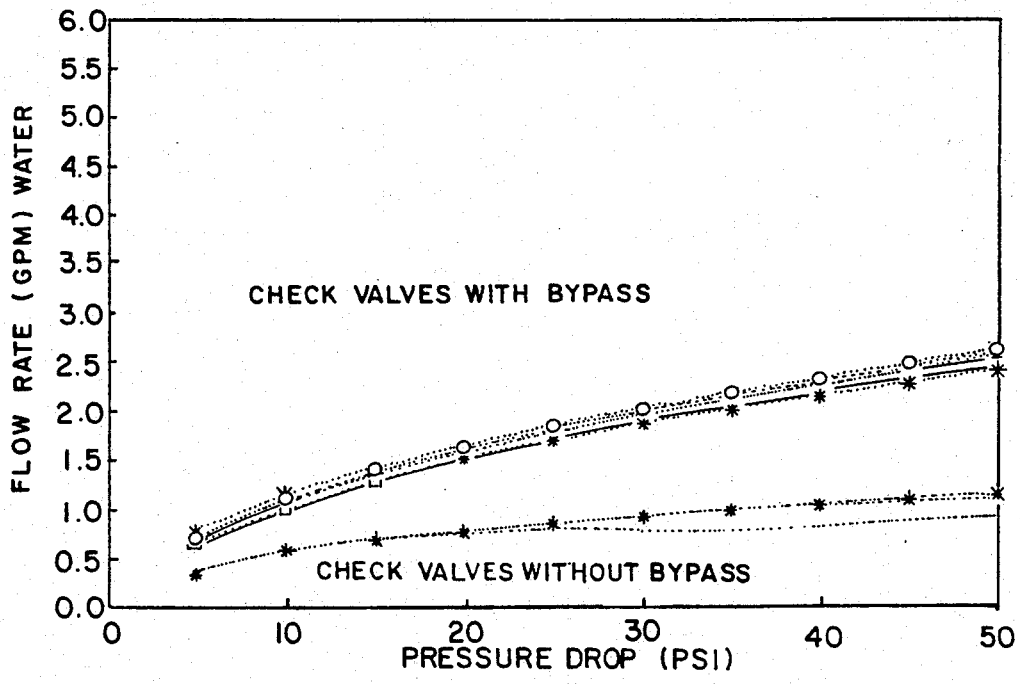
FIG. 9 is a graph showing the effect of the pressure relief port on flow rate.

When valve 203 is operated with reverse flow and check valve 209 is opened by the flow of refrigerant, relief port 256 provides the fluid contained in guide path chamber 253 with an escape. Thus, the opening of check valve 209 displaces, rather than pressurizes, this fluid, allowing check valve 209 to be more quickly and more fully opened to allow for a greater flow through the by-pass flow path 243. The fluid in guide chamber 253 is under high pressure. Without pressure by-pass 256, the movement of ball 249 is significantly hindered by the fluid in guide chamber 253. The improved results provided by the pressure relief port 256 on the flow rate through the check valve are shown in FIG. 9.

Numerous variations, within the scope of the appended claims, will be apparent to those skilled in the art in light of the foregoing description and accompanying drawings. For example, thermostatic head 23 and bulb 35 could be replaced with electrically energizable expansion means, such as described in U.S. Pat. No. 3,907,781 to Kunz, or any other means to control the opening of port 17.

A spring loaded needle could replace the spring loaded check ball 49. A spring biased swing check valve or tilting disk check valve (not shown) could also be used in place of check valve ball 49.

What is claimed is:

1. In a heat pump system comprising a compressor having an inlet and an outlet, a first heat exchanger to be located outdoor, a second heat exchanger to be located indoors, said indoor and outdoor heat exchangers being in communication with one another, a shiftable valve connected to the outlet and the inlet of the compressor and to the outdoor and indoor heat exchangers, said valve being selectively shiftable between a first position in which refrigerant is delivered from the outlet of the compressor to the outdoor heat exchanger such that the heat pump system is operated in a cooling mode and a second position in which refrigerant is delivered form the outlet of said compressor to said indoor heat exchanger such that said heat pump system is operated in a heating mode, and at least one thermostatic expansion valve between said indoor and said outdoor heat exchangers, said thermostatic expansion valve comprising a valve body including a flowpath therethrough having an inlet and an outlet, a thermal expansion port in said flowpath, movable valve means to selectively open and close said expansion port, wherein the improvement comprises: an internal by-pass flow path within said valve body, said by-pass flowpath having a check valve therein, said check valve being in fluid communication with said valve body flowpath inlet and with said valve body flowpath outlet, said check valve comprising a check valve seat, a movable check valve ball separate from said expansion valve means, means for biasing said check valve toward its said closed position, and means for fully opening said check valve; said check valve ball being movable in a guide path between a closed position in which said check valve member engages said check valve seat thereby to block the flow of refrigerant through said by-pass flow path from said inlet to said outlet, and an open position in which said check valve member is clear of said check valve seat thereby to permit flow of refrigerant from said outlet to said inlet through said by-pass flow path around said expansion port; said means for fully opening said check valve including a pressure relief port in said guide path, said pressure relief means providing an escape for fluid contained in said guide path.

2. The expansion valve of claim 1, wherein said biasing means is a coil spring.

3. The thermal expansion valve of claim 2 wherein said spring has a spring force sufficiently light so as to permit said check valve member to be opened substantially instantaneously when said compressor is operated at low pressure.

4. The heat pump system of claim 1 wherein said pressure relief port places said guide path in fluid communication with said expansion valve body inlet.

5. A thermostatic expansion valve comprising:

a valve body including a flowpath therethrough having an inlet and an outlet;

a thermal expansion port in said flowpath;

movable valve means to selectively open and close said expansion port; and an internal by-pass flow path extending between said flow path inlet and outlet and having a check valve therein, said check valve comprising a check valve inlet and a check valve outlet; a check valve seat, a guide path chamber; a check valve member being movable between a closed position in which said check valve member engages said check valve seat to block the flow of refrigerant from said inlet to said outlet through said by-pass flow path, and an open position in which said check valve member is clear of said check valve seat to permit flow of refrigerant from said outlet to said inlet through said by-pass flow path around said expansion port; and means for relieving pressure within said guide path chamber when said check valve member moves to an open position; said pressure relief means including a pressure relief port in said valve body communicating between said guide path chamber and said check valve outlet.

6. A thermostatic expansion comprising:

a valve body including a flowpath therethrough having an inlet and an outlet;

a thermal expansion port in said flowpath;

movable valve means to selectively open and close said expansion port; and a by-pass flow path extending between said flow path inlet and outlet and having an internal check valve within said valve body, said check valve comprising:

a check valve inlet and a check valve outlet;

a check valve seat;

a guide path chamber;

a check valve member being movable between a closed position in which said check valve member engages said check valve seat to block the flow of refrigerant from said inlet to said outlet through said by-pass flow path, and an open position in which said check valve member is clear of said check valve seat to permit flow of refrigerant from said outlet to said inlet through said by-pass flow path around said expansion port; and means for relieving pressure within said guide path chamber when said check valve member moves to an open position; said pressure relief means including a pressure relief port in said valve body communicating between said guide path chamber and said check valve outlet.

7. A thermostatic expansion valve comprising: a valve body including a flowpath therethrough having an inlet and an outlet; a thermal expansion port in said flowpath; movable valve means to selectively open and close said expansion port; and an internal by-pass flow path within said valve body extending between said inlet and outlet and having a check valve therein, said check valve comprising a check valve seat, and a movable check valve member separate from said expansion valve means, said check valve member being movable in a guide path having a closed end between a closed position in which said check valve member engages said check valve seat thereby to block the flow of refrigerant from said inlet to said outlet through said by-pass flow path, and an open position in which said check valve member is clear of said check valve seat thereby to permit flow of refrigerant from said outlet to said inlet through said by-pass flow path around said expansion port, means for biasing said check valve toward its said closed position; and means for relieving pressure within said guide path when said check valve is moved to its open position.

8. A expansion valve of claim 7, wherein said biasing means is a coil spring and said valve means is a ball.

9. A thermal expansion valve of claim 8 wherein said spring has a spring force sufficiently light so as to permit said check valve member to be opened substantially instantaneously when said compressor is operated at low pressure.

10. The expansion valve of claim 7 wherein said pressure relief means comprises a port in said guide path which places said guide path in fluid communication with said expansion valve body inlet to provide an escape for fluid contained in said guide path.

* * * * *